US008597065B2

(12) United States Patent
Mounier et al.

(10) Patent No.: US 8,597,065 B2
(45) Date of Patent: Dec. 3, 2013

(54) SLEEVE FOR ELECTRICAL CONNECTORS AND METHOD OF ASSEMBLING

(75) Inventors: Laurent Mounier, Voiron (FR); Serge Perrot, Montferrat (FR)

(73) Assignee: Radiall, Rosny Sous Bois (FR)

( * ) Notice: Subject to any disclaimer, the term of this patent is extended or adjusted under 35 U.S.C. 154(b) by 50 days.

(21) Appl. No.: 13/345,318

(22) Filed: Jan. 6, 2012

(65) Prior Publication Data

US 2012/0184158 A1 Jul. 19, 2012

(30) Foreign Application Priority Data

Jan. 14, 2011 (FR) ..... 11 50317

(51) Int. Cl.
*H01R 9/24* (2006.01)
*H01R 13/02* (2006.01)

(52) U.S. Cl.
USPC ..... 439/889; 439/843

(58) Field of Classification Search
USPC ..... 439/889, 843, 851
See application file for complete search history.

(56) References Cited

U.S. PATENT DOCUMENTS 4,657,335 A 4/1987 Koch et al.
5,667,413 A * 9/1997 Trafton ..... 439/843
5,735,716 A 4/1998 Bilezikjian
6,042,432 A * 3/2000 Hashizawa et al. ..... 439/843
6,328,615 B1 * 12/2001 Safai ..... 439/851
6,482,049 B1 * 11/2002 Swearingen ..... 439/843
6,752,668 B2 * 6/2004 Koch, Jr. ..... 439/843
6,837,756 B2 * 1/2005 Swearingen et al. ..... 439/843
6,899,571 B1 5/2005 Koch et al.
7,048,596 B2 * 5/2006 Swearingen et al. ..... 439/843
7,387,532 B1 * 6/2008 Mao ..... 439/578
2003/0068931 A1 4/2003 Swearingen et al.

FOREIGN PATENT DOCUMENTS

NL 6 406 224 A 12/1964
WO WO 2009/099789 A1 8/2009

OTHER PUBLICATIONS

Jul. 13, 2011 Extended Search Report issued in French Application No. 11 50317 (with translation).

* cited by examiner

*Primary Examiner* — Hae Moon Hyeon

(74) *Attorney, Agent, or Firm* — Oliff & Berridge, PLC

(57) ABSTRACT

An electrically conductive sleeve for electrical connectors, the sleeve extending around a longitudinal axis and having a first end and a second end, the second end being opposite the first end, at least one slot being produced in the sleeve and extending from the first end in the direction of the second end, and including at least one lug extending transversely, notably radially, relative to the axis of the sleeve.

10 Claims, 5 Drawing Sheets

SLEEVE FOR ELECTRICAL CONNECTORS AND METHOD OF ASSEMBLING

BACKGROUND

The present invention consists in an electrically conductive sleeve for electrical connectors as well as such an electrical connector.

The invention aims to provide a connector enabling an electrical signal to be conveyed having a high power and/or a high intensity and the connection of which to a connector of complementary type necessitates only a low connection force. Such a connector is advantageously able to withstand a great number of connection/disconnection cycles.

For example, the connection or disconnection forces may be less than 10 Newtons and this connector may advantageously retain its electrical characteristics after 10 000 connection/disconnection cycles.

The power of the electrical signal is for example of the order of a few tens of kW with an intensity of 125 A. Such a connector may be used for charging electric vehicles or for applications in the medical field. In the context of the invention, the term "vehicle" must be understood very broadly, as will emerge hereinafter.

A problem arising in transmitting high powers via coupled electrical connectors is the high contact resistance between the two coupled connectors. The higher this contact resistance the higher the power dissipated by the Joule effect, which may affect the efficacy and the safety of the connection made in this way between the two connectors. It is therefore desirable to reduce this contact resistance.

One solution known from the application WO 2009/099789, for example, is to multiply the points of electrical contact between the two connectors when they are coupled. The application WO 2009/099789 teaches using a connector including a barrel inside which are disposed electrically conductive sleeves, each of these sleeves having at one end a split part defining a plurality of tongues. Each of these tongues forms points of contact with the connector of complementary type designed to be received within the sleeves.

SUMMARY

However, if the barrel and the sleeves disclosed by this application WO 2009/099789 are fastened to a body intended to be crimped onto an electrical cable, a high electrical resistance may exist between the sleeves and that body. Furthermore, the operation of fastening the sleeves and/or barrel to the body may degrade the sleeve(s) and/or barrel.

There exists a requirement to remedy the aforementioned drawbacks.

An object of the invention is to respond to that requirement. It achieves this, in one of its aspects, thanks to an electrically conductive sleeve for electrical connectors, the sleeve extending around an axis, notably having a tubular shape, and having a first end and a second end, the second end being opposite the first end and notably being configured to come to bear on a body of the electrical connector, at least one slot being produced in the sleeve and extending from the first end in the direction of the second end, the sleeve being characterized in that it includes at least one lug extending transversely, notably radially, relative to the axis of the sleeve.

Thanks to the presence of the lug or lugs, the electrical contact between the sleeve and the body of the connector may be reinforced. Furthermore, the positioning of the sleeve on the body may be simplified thanks to the presence of the lug or lugs, which may guarantee that the points of contact with the connector of complementary type that are defined at the first end of the sleeve are correctly positioned relative to that connector of complementary type. Finally, thanks to the lug or lugs, the axial position of the sleeve in a barrel when the sleeve is fitted around the body may be ensured, the lug being able to oppose axial movements of the sleeve in the barrel.

The lug may be produced in one piece with the rest of the sleeve. Alternatively, the lug is attached to the sleeve. In the latter case, the connection between each lug and the sleeve may be effected by riveting, crimping or welding.

The lug may be provided at the second end of the sleeve.

The lug may extend transversely toward the exterior of the sleeve. The lug extends radially, for example, i.e. perpendicularly to the axis of the sleeve and toward the exterior thereof, which may make it possible to prevent the sleeve sliding in the barrel.

The sleeve may include a plurality of lugs. These lugs may be of the same size and distributed uniformly or otherwise around the axis of the sleeve.

The sleeve may include at its first end a plurality of slots, two adjacent slots defining a flexible tongue carrying one or more points of contact with the connector of complementary type. Each tongue may extend obliquely toward the interior of the sleeve relative to the axis of the sleeve.

The sleeve may have an interior housing into which the pin of the connector of complementary type may be introduced.

The sleeve may have an outside diameter in the range 2 to 20 mm. The sleeve may have a height in the range 5 to 50 mm. In the context of the invention, the term "height" refers to the dimension of the sleeve measured along its axis.

The axis of the sleeve may be rectilinear.

The sleeve may be produced by means of the so-called "cut-rolled" technology or by stamping.

Another aspect of the invention consists in an electrical connector including:

a body, and a barrel, characterized in that it includes at least one sleeve as defined above.

The lug or lugs of the sleeve may be disposed between the body and the barrel when the connector is assembled.

The body is attached to the barrel, for example by crimping and notably by circular crimping, and such an operation may make it possible to increase the contact pressure between the lug or lugs of the sleeve or sleeves and the body. This increase in the contact pressure may make it possible to reduce the electrical resistance between the sleeve or sleeves and the body. The chain of resistances along the coupled connectors may thus be further reduced.

The barrel may include a housing in the interior of which the sleeve is disposed.

The connector may include at least two sleeves, the two sleeves having different dimensions. The dimensions of the sleeves may be chosen in such a manner that one of the sleeves is received in the interior of the other sleeve. The dimensions of the sleeves may be chosen in such a manner that they have different heights. When they are disposed in the barrel, the axes of the sleeves may coincide.

Each of the sleeves may have a first end with one or more slots defining tongues, as mentioned above. Such sleeves may make it possible to create a large number of points of contact between the connector and the connector of complementary type, the latter being intended to be received in the interior of the sleeve of smaller transverse size. About 100 points of contact may be created in this way between the connector and the connector of complementary type.

The heights of the sleeves may be different so that the first ends of each sleeve are in succession along the barrel.

Each sleeve may or may not include the same number of lugs and the sleeves may be disposed in the interior of the barrel in such a manner that from one sleeve to another the lugs do not occupy the same position on the perimeter of the barrel.

The barrel may have a height at least equal to that of the sleeve, where applicable the sleeve of greatest height, in such a manner as to define protection means for the sleeve or sleeves.

The barrel may extend beyond the first end of the sleeve, where appropriate the sleeve of greatest height, in such a manner as to define means for guiding the pin of the connector of complementary type during its coupling with the connector.

The connector comprises for example three sleeves each having slots at a first end and lugs at a second end.

The lugs of each sleeve may be applied against a common part of the barrel and be brought into contact with the body.

The connector of the invention may be configured to transmit an electrical signal of at least 10 A intensity, for example an intensity equal to 125 A and a power equal to a few tens of kW.

The connector is for example configured to be assembled onto an electrical cable, the body notably including a housing for receiving the cable. This housing is a blind housing, for example.

The connector may be straight, having a rectilinear longitudinal axis.

The connector may instead be an elbow connector.

In an application to charging electric vehicles, the connector of the invention may equally well be applied to the connection between an electrical cable and a charging terminal or the connection between an electrical cable and the electrical vehicle. The vehicle may have two, three or four wheels, or more. It is for example an electrical car, motorcycle or bicycle.

The connector of the invention may be a connector of male or female type. A connector of the invention of male type and a connector of the invention of female type may form a male-female connection pair.

BRIEF DESCRIPTION OF THE DRAWINGS

The invention may be better understood after reading the following description of nonlimiting examples of an embodiment thereof and examining the appended drawings, in which.

DETAILED DESCRIPTION OF THE EMBODIMENTS

Figure 1:
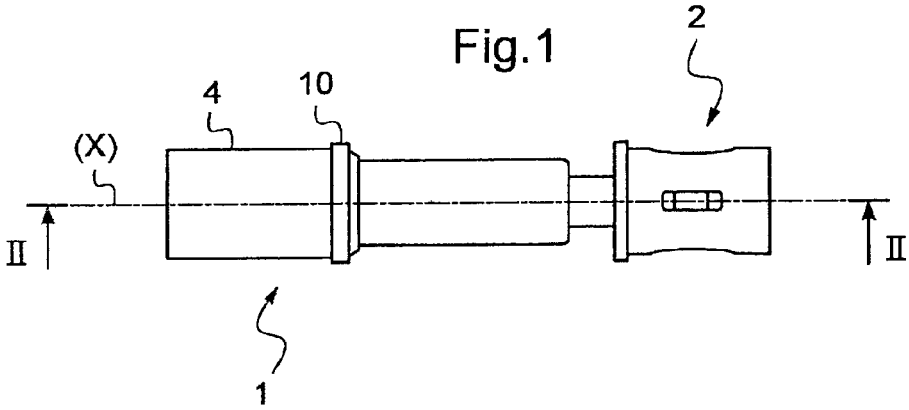
FIG. 1 shows a female bush of the invention coupled to a male pin.

FIG. 1 shows diagrammatically a connector 1 conforming to a first embodiment of the invention. This connector 1 is configured to be coupled to a connector 2 of complementary type. In the example described the connector 1 is a bush and the connector 2 is a pin, although the invention is not limited to such an example.

The connectors 1 and 2 enable transmission of an electrical signal of greater than 10 A intensity, for example in the context of charging an electrical vehicle.

Figure 3:
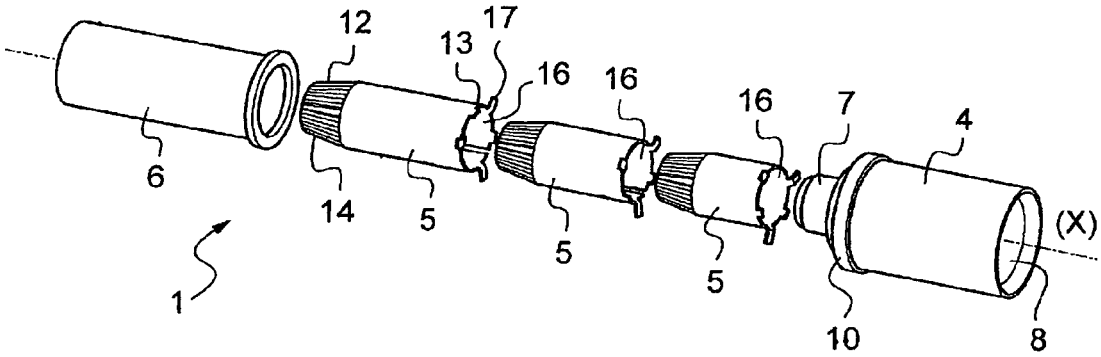
FIG. 3 is an exploded view of an example of a bush of the invention.

The connector 1 is shown on its own in FIG. 3. This connector 1 includes a body 4, one or more sleeves 5 and a barrel 6. In the example shown three sleeves 5 are provided but the invention is not limited to a particular number of sleeves, which number may be in the range 1 to 3 or greater than 3.

The body 4 includes a blind interior housing 8 in which an electrical cable, not shown, on which the connector 1 is mounted may be disposed. The body 4 may be produced in metal, for example in copper, brass or aluminum or in any other material having good electrical conduction properties. For example, materials may be chosen having a % International Annealed Copper Standard (IACS) >50%. The % IACS is a means of comparing the electrical conductivities of materials relative to the conductivity of pure copper.

This body 4 extends along a longitudinal axis X and includes an annular bearing surface 10 extending around and perpendicularly to the axis X. This bearing surface 10 is shown in detail in FIG. 10, for example. As may be seen in FIG. 10, a flange formed by an annular wall 11 may extend from this bearing surface 10 in a direction away from the rest of the body and along the axis X thereof. In the example shown this wall 11 surrounds a tubular portion 7 projecting beyond said wall 11 and defining one longitudinal end of the body 4.

The annular wall 11 may have a greatest transverse dimension less than that of the bearing surface 10 and a step may be provided between the bearing surface 10 and the wall 11.

In the examples shown each sleeve 5 has a substantially tubular shape around an axis that coincides with the axis X of the body when the connector 1 is assembled. Hereinafter the sleeves are distinguished as a function of their dimensions by referring to them as "small sleeves", "medium sleeves", and "large sleeves".

Each sleeve has at a first end 12 relative to the axis X a plurality of slots 14 extending from this first end 12 toward a second end 13 of the sleeve, these slots 14 defining tongues 15 (see FIG. 4) the function of which is described hereinafter. For example, the slots 14 are substantially parallel to the axis of the sleeve 5 over a distance in the range 5 to 15% of the height of the sleeve. This distance may be calculated so that the geometry of the tongue defined in this way is compatible with elastic deformation of the tongue on introduction of the pin into the sleeve. The geometry of the tongue depends for example on at least one of the following parameters: the length of the tongue, the thickness of the material, and the angle of the tongue relative to the axis of the sleeve.

This elastic deformation guarantees that after a connection/disconnection cycle the tongue returns to its rest position and is able to accomplish a new connection/disconnection cycle without loss of electrical or mechanical properties of the sleeve.

The tongues may extend obliquely relative to the axis of the sleeve and toward the interior thereof.

A through-housing 16 may be provided in each sleeve along the axis X, this housing extending between the first end 12 and the second end 13 of the sleeve 5.

In the example considered here each sleeve 5 includes a plurality of lugs 17 at its second end 13. Each sleeve may include the same number of lugs, this number being in the range 2 to 10, for example. As may be seen, the lugs may be distributed uniformly around the axis of the sleeve. The lugs 17 extend radially outwards relative to the axis of the sleeve.

Figure 4:
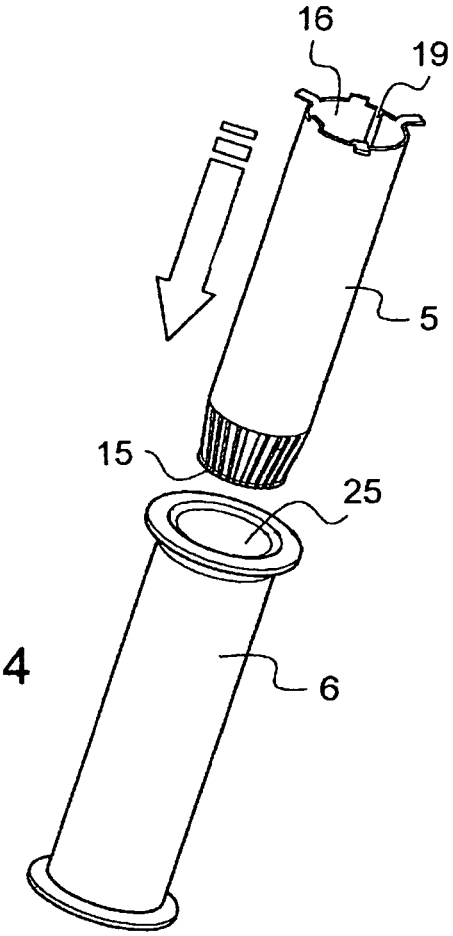
FIG. 4 or 12 show diagrammatically and partially various steps in the assembly of the bush from FIG. 3.

A slot 19, visible in FIG. 4, may be provided over the full height of each sleeve 5. This slot 19 allows slight deformation of the sleeve when it is assembled into the interior of the barrel or another sleeve of greater diameter. On resuming its initial position, the sleeve 5 may remain with its outside diameter pressed against the barrel or a sleeve of greater diameter.

This slot results from the use for the production of the sleeves 5 of the "cut-rolled" technology. In this case, each sleeve 5 is produced from sheet metal that is first cut to produce the slots and the lugs, after which these shapes are curved to the required geometry, and finally rolled to give an approximately cylindrical shape. The slot 19 is delimited by the edges of the rolled sheet metal.

In other examples the sleeves 5 are produced other than by the "cut-rolled" technology, for example by stamping, and the sleeves 5 may have no such slots 19.

For example, each sleeve 5 is produced in copper, brass, aluminum or any other material(s) having satisfactory electrical conduction properties and good elasticity properties.

As may be seen in FIG. 3, the sleeves 5 may have different transverse and longitudinal dimensions, so that one sleeve may be disposed entirely, both transversely and longitudinally, in the interior of another sleeve. In the FIG. 3 example, the small sleeve 5 has transverse and longitudinal dimensions such that it is entirely received in the interior of the medium sleeve, the tongues 15 of this medium sleeve extending beyond the first end 12 of the small sleeve when the latter is disposed in the interior of the medium sleeve.

The same applies to the medium sleeve relative to the large sleeve, in other words the medium sleeve may be entirely received in the interior of the large sleeve both transversely and longitudinally, the tongues 15 of the large sleeve extending beyond the first end 12 of the medium sleeve.

Such different lengths of the sleeves 5 may, when the latter sleeves are disposed one in the other, enable a succession of tongues 15 to be obtained along the axis common to the sleeves, enabling a large number of points of contact with the pin of the connector 2 of complementary type to be produced when the latter is introduced into the interior of the housing 16 provided in the small sleeve.

The barrel 6 may have a generally tubular shape the axis of which is common with that of the sleeve or sleeves 5 and the body 4 when the connector 1 is assembled. This barrel may have one longitudinal end 20 adapted to cooperate with the body 4. The longitudinal end 20 may be formed by a frusto-conical portion 21 including a wall receiving the crimping 22 diverging from the axis of the barrel and a end wall 23 perpendicular to the axis of the barrel 6. The end wall may extend all around the axis of the barrel and have a greater transverse dimension, notably diameter, enabling this end wall 23 to be received in the interior of the space delimited externally by the annular wall 11 of the body 4. A through-housing 25 may be defined in the barrel 6, this housing 25 extending along the axis of the barrel 6.

Figure 2:
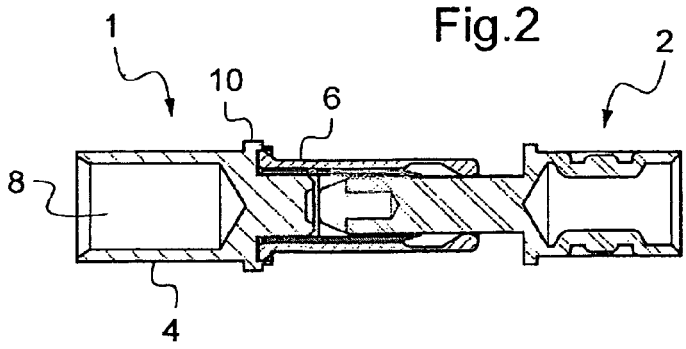
FIG. 2 is a view in section taken along the line II-II in FIG. 1.

The barrel 6 may extend along its axis over a length at least equal to that of the largest sleeve 5, or over a length greater than that of the largest sleeve 5, so as to ensure both a function of protecting the sleeve 5 and a function of guiding the connector 2 of complementary type when the latter is introduced into the barrel 6 to be connected to the connector 1, as shown in FIGS. 1 and 2.

Various steps of assembling the connector 1 from FIG. 3 are described next with reference to FIGS. 4 to 12.

Figure 5:
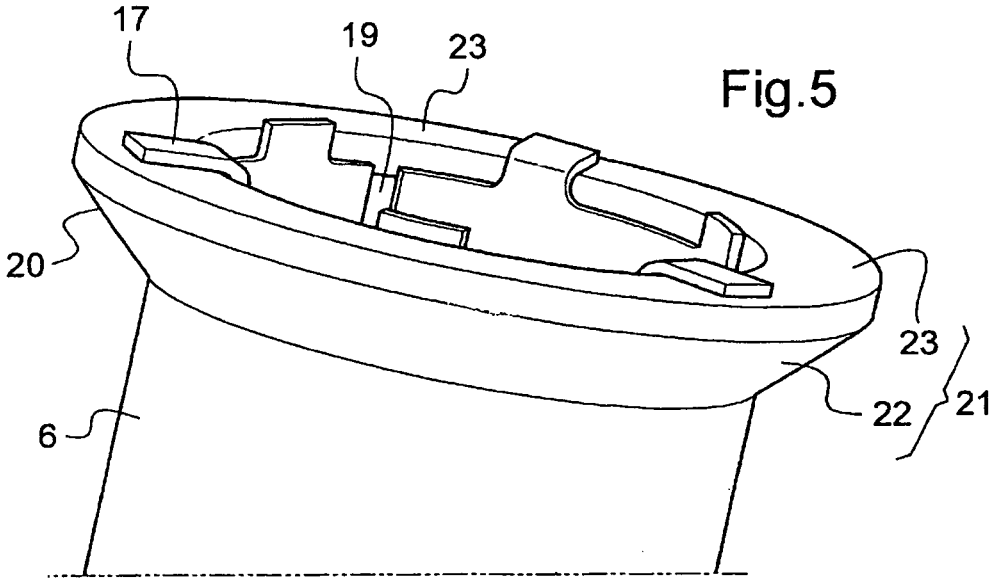

In a first step shown in FIG. 4, the largest sleeve 5 is introduced into a housing 25 provided in the barrel 6, this housing 25 having a shape and size adapted to receive this large sleeve 5. After this step, as shown in FIG. 5, the lugs 17 of the large sleeve 5 rest against the end wall 23 of the barrel 6.

Figure 6:
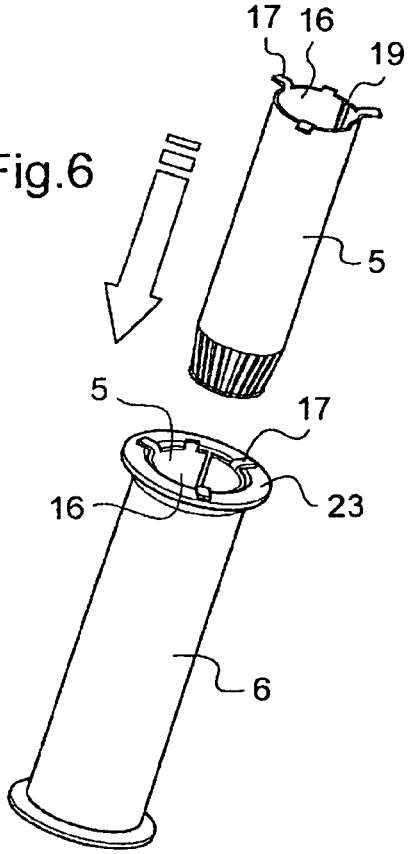

During a subsequent step, shown in FIG. 6, the medium sleeve 5 is disposed in the housing 16 provided in the large sleeve 5. After this step, the lugs 17 of this medium sleeve 5 rest against the end wall 23 of the barrel 6, the medium sleeve 5 advantageously being introduced into the large sleeve 5 in such a manner that its lugs 17 do not overlap those of the large sleeve, i.e. in such a manner that the lugs 17 of the medium sleeve occupy on the perimeter of the end wall 23 positions different from those occupied by the lugs of the large sleeve 5.

Figure 7:
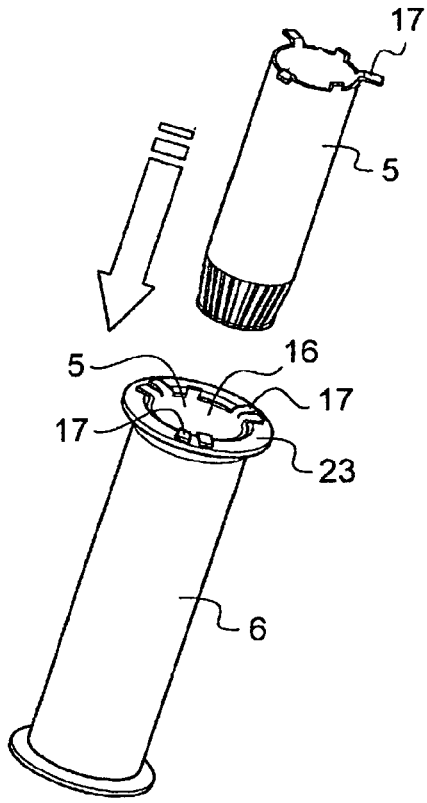
Figure 8:
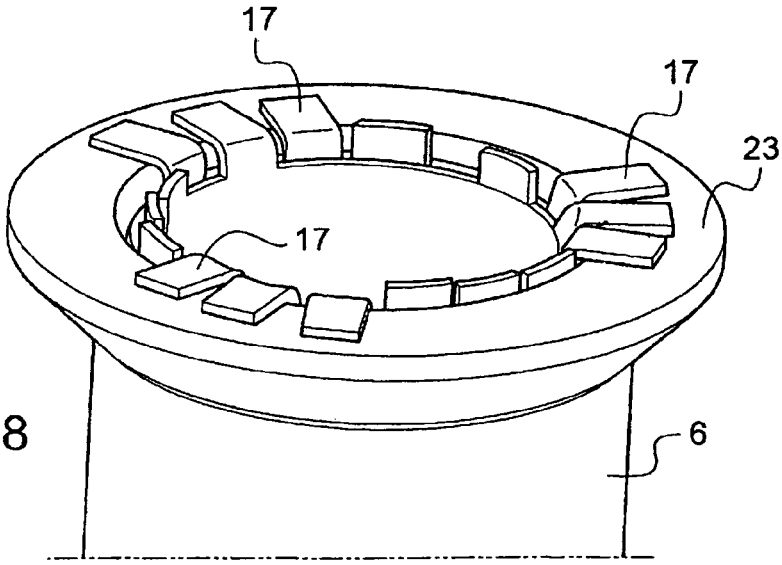

During a subsequent step shown in FIG. 7, the small sleeve 5 is introduced into the housing 16 provided in the medium sleeve 5. After this step, as shown in FIG. 8, the lugs 17 of each of the sleeves may be applied against the end wall 23 without overlapping each other, each sleeve 5 advantageously having been positioned in the barrel 6 to obtain this result.

Figure 9:
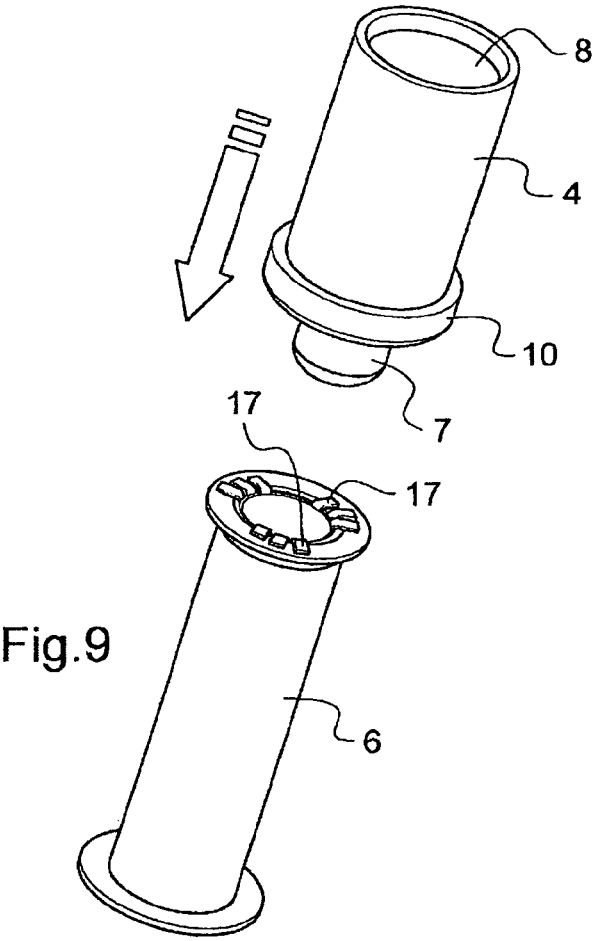

During a subsequent step, which is shown in FIG. 9, the body 4 is applied against the "barrel-sleeves" subassembly obtained following the preceding steps. During this step, the bearing surface 10 of the body 4 is brought to bear against the end wall 23 of the barrel 6 and the tubular portion 7 defining one end of the body 4 in the interior of the housing 16 provided in the small sleeve, as may be seen in FIG. 9.

Figure 10:
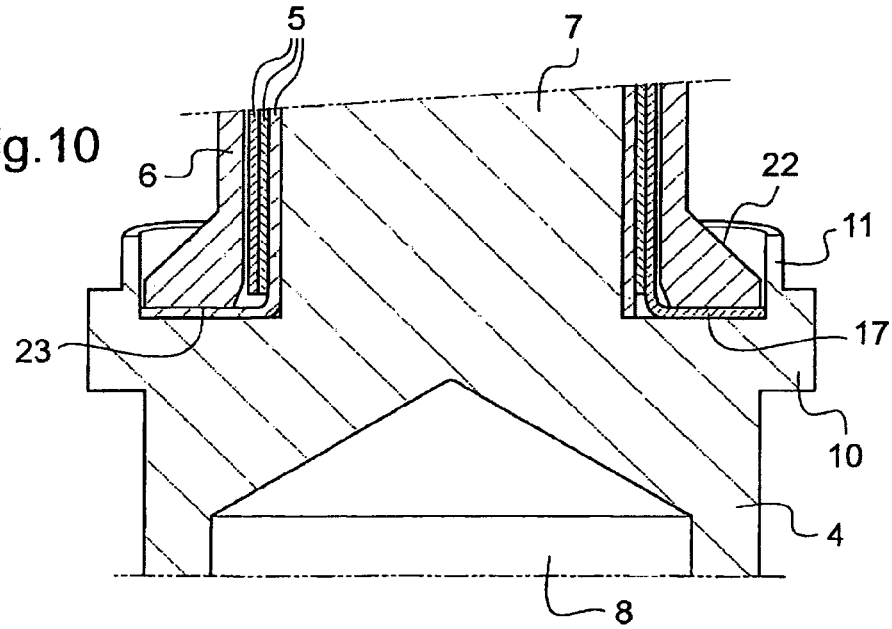

After this step, as shown in FIG. 10, the lugs 17 of the sleeves 5 are trapped between a transverse wall of the bearing surface 10 of the body 4 and the end wall 23 of the barrel 6.

Figure 11:
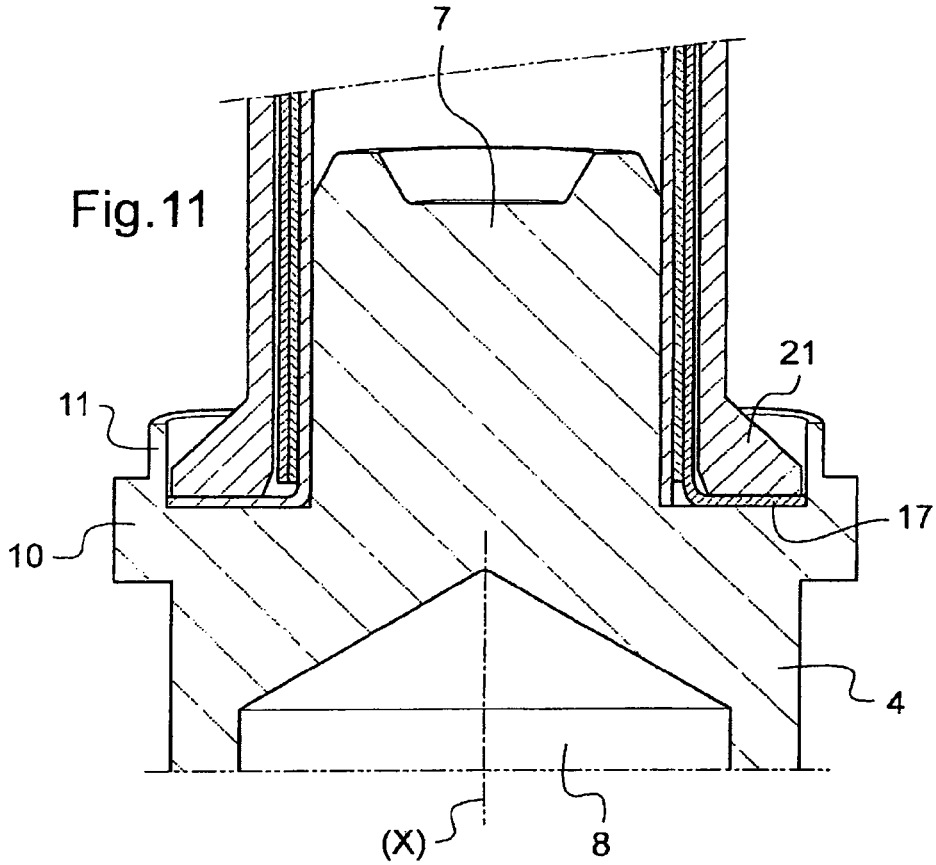
Figure 12:
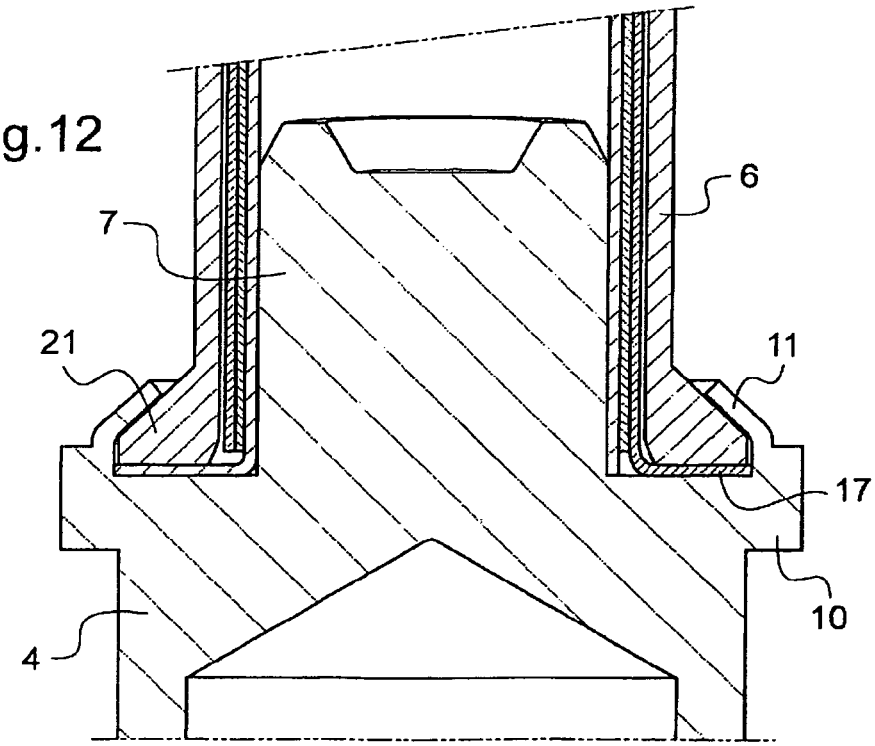

During the subsequent step, which is shown in FIGS. 11 and 12, the body 4 is fastened to the barrel 6 and to the sleeves 5. In the example described here this fastening consists in crimping the body 4 onto the barrel 6. The annular wall 11 of the body is crimped onto the crimping wall 22 of the frusto-conical portion 21 of the barrel 6, for example.

After this step, the connector 1 is assembled as shown in FIG. 12, which ensures mechanical retention of the various elements of the connector 1 and increased pressure forces between the sleeves 5 and the body 4. Microwelds may be effected during this crimping.

The invention is not limited to the two examples that have just been described.

Thus the invention enables a connector to be produced that is adapted to establish a plurality of points of contact with a connector of complementary type, for example a pin the diameter of which is less than 10 mm, for example 6 mm, in which case the connector of the invention may be a socket.

When they are assembled, the connector 1 of the invention and the connector 2 of complementary type may have a very low contact resistance, for example less than 0.5 mΩ.

The force necessary to couple and to uncouple the connectors 1 and 2 may be relatively low, being less than 10 N, for example, notably less than 7 N.

A connector 1 of the invention may be particularly able to withstand high currents, notably currents greater than 10 A.

The heating induced by the transmission of such a current may be relatively low. In the case of a connector transmitting a signal on three phases with a distance between centres of 16 mm, if the electrical signal has an rms value of 125 A, the temperature rise after three hours at the level of the connection between the cable and the pins may be less than 502K.

In the example shown here, the pin of the connector of complementary type includes an insulative cap.

The expression "including a" may be understood as meaning "including at least one" unless the contrary is specified.

The invention claimed is:

1. An electrical connector including:

a body;

a barrel; and at least two electrically conductive sleeves, each sleeve extending around a longitudinal axis and having a first end and a second end, the second end being opposite the first end, at least one slot being produced in each sleeve and extending from the first end in a direction of the second end, wherein:

each sleeve includes at least one lug extending radially relative to the longitudinal axis of the sleeve, the sleeves have different dimensions, in such a manner than one sleeve can be received in an interior of the other sleeve, and a part of at least one sleeve is disposed between the body and the barrel.

2. The electrical connector according to claim 1, wherein the lug is produced in one piece with the rest of the sleeve.

3. The electrical connector according to claim 1, wherein the lug is produced at the second end of the sleeve.

4. The electrical connector according to claim 1, wherein the lug extends radially toward an exterior of the sleeve.

5. The electrical connector according to claim 1, wherein each sleeve includes a plurality of lugs uniformly distributed around the longitudinal axis of the sleeve.

6. The electrical connector according to claim 1, including at the first end of each sleeve a plurality of slots, two adjacent slots defining a flexible tongue carrying one or more points of contact with a complementary connector.

7. The electrical connector according to claim 1, wherein the lug of each sleeve is disposed between the body and the barrel.

8. The electrical connector according to claim 1, wherein the barrel includes a housing in an interior of which the sleeve is disposed.

9. The electrical connector according to claim 1, each sleeve including a same number of lugs.

10. The electrical connector to claim 1, wherein the sleeves are disposed in the interior of the barrel so that from one sleeve to another the lugs do not occupy a same position on a perimeter of the barrel.

* * * * *